US005605523A

United States Patent [19]

Ish, III et al.

[11] Patent Number: 5,605,523

[45] Date of Patent: Feb. 25, 1997

[54] MULTIPLE STATION SINGLE STACK WEIGHT LIFTING APPARATUS WITH DIRECT LIFT PRESS

[75] Inventors: A. Buell Ish, III; L. Kent Lines, both of Carnation, Wash.

[73] Assignee: Vectra Fitness, Inc., Redmond, Wash.

[21] Appl. No.: 283,602

[22] Filed: Aug. 1, 1994

Related U.S. Application Data

[63] Continuation-in-part of Ser. No. 838,472, Feb. 19, 1992, Pat. No. 5,336,148.

[51] Int. Cl.[6] ..... A63B 21/00

[52] U.S. Cl. ..... 482/99; 482/97; 482/138; 482/908

[58] Field of Search ..... 482/94–103, 112, 482/113, 129, 130, 136–138

[56] References Cited

U.S. PATENT DOCUMENTS

| | | | |
|---|---|---|---|
| Re. 34,572 | 3/1994 | Johnson et al. | 482/99 |
| 3,858,873 | 1/1975 | Jones | 482/97 |
| 4,697,809 | 10/1987 | Rockwell | 482/99 |

OTHER PUBLICATIONS

Paramount Products Catalog, p. 6, publication date <1 year prior to filing date.

Universal Products Catalog, pp. 4–5, publication date <1 year prior to filing date.

Vectra Fitness On–Line 3500 product catalog, all pages, 1992.

*Primary Examiner*—Richard J. Apley

*Assistant Examiner*—John Mulcahy

*Attorney, Agent, or Firm*—Stephen M. Evans; David L. Garrison

[57] ABSTRACT

A multiple station weight lifting type exercise apparatus having cabled linkage and direct lifting capabilities is disclosed. The apparatus is characterized as having a plurality of exercise stations located about a base platform and a single weight stack being movable in a conventional manner through direct and indirect forces applied thereto by the various exercise stations. Each station generally has several apparatus connectable to one or more cables that are operatively linked to all other stations and effect movement of the weight stack preferably by a single cable when any cable undergoes tensioned movement. In addition, at least one station directly imparts movement of the weight stack by means of non-cable linkage. The non-cabled linkage or direct lift of the weight stack is carried out by providing for a translation assembly to be located in operative engagement with the weight stack to which the cable, operatively linked to other stations, is anchored. The direct lift translation assembly engages the weight stack at a location under the cabled connection so that the weight stack is unaffected by the presence of the direct lift station and conversely, movement of the weight stack by tensioned movement of a cable by an exercise station does not affect the direct lift station. A feature of the invention provides for the use of a parallelogram lifting assembly to modify the nature of arcuate travel of a press handle assembly associated therewith. Another feature of the invention concerns an angle adjustment assembly for modifying the user engagable member of a movable member thereof that is linked to the load.

17 Claims, 6 Drawing Sheets

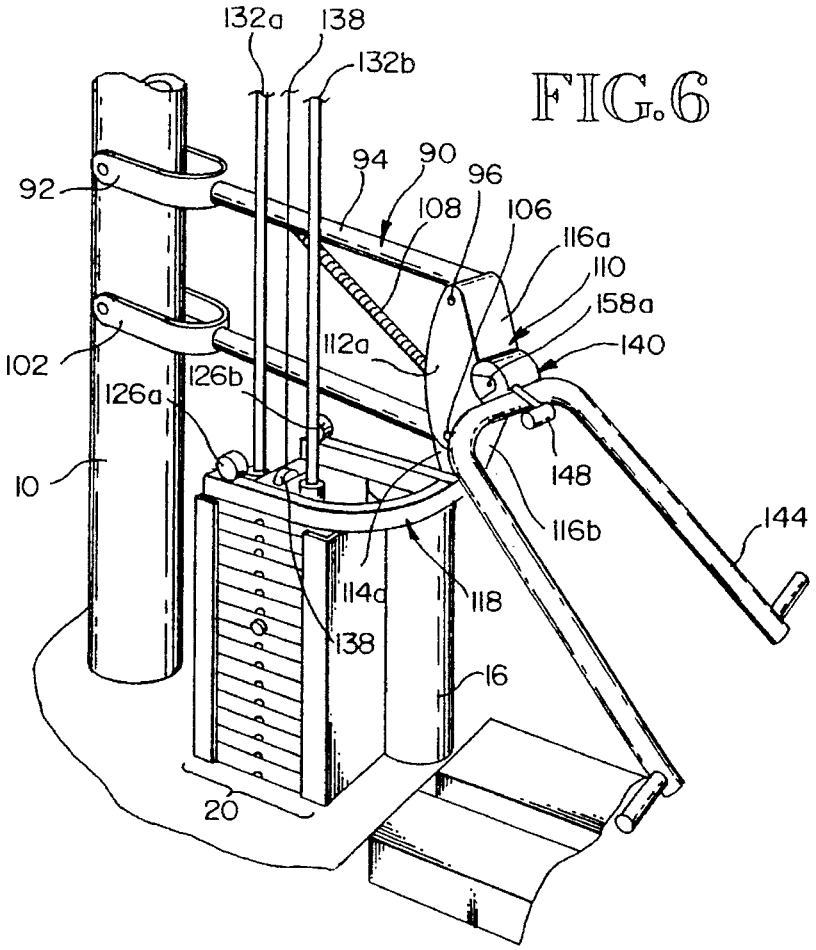
FIG. 6
FIG. 6A
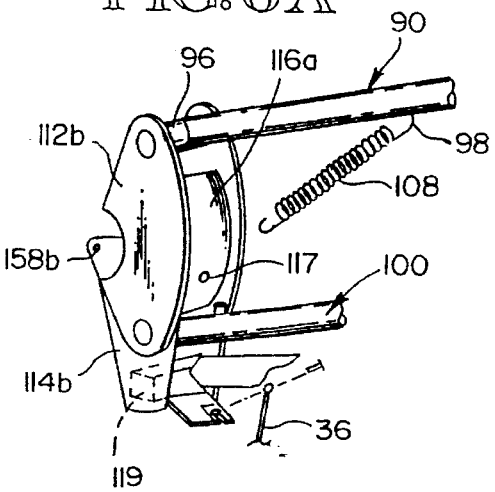
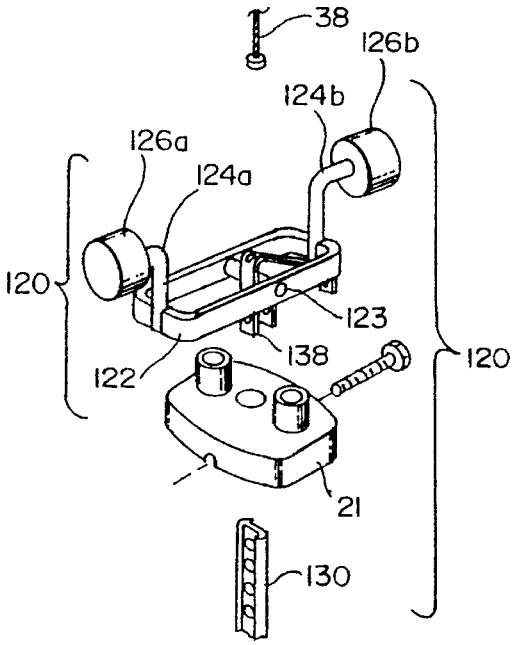
FIG. 7

MULTIPLE STATION SINGLE STACK WEIGHT LIFTING APPARATUS WITH DIRECT LIFT PRESS

This application is a continuation-in-part of commonly owned, U.S. patent application Ser. No. 07/838,472, filed on Feb. 19, 1992, and issued on Aug. 9, 1994, as U.S. Pat. No. 5,336,148.

FIELD OF THE INVENTION

The present invention pertains to a multiple station weight lifting exercise apparatus and more particularly to such an apparatus having certain stations operatively linked by cable to a load and at least one station directly operating the same load.

BACKGROUND OF THE INVENTION

In recent years, there has been a trend towards integrating many of the traditional single purpose weight lifting exercise machines used to increase muscular strength into a fewer number of multipurpose machines. These integrated weight machines were designed to provide numerous articulating resistive exercises in less space than would otherwise be required when using dedicated machines.

The initial embodiment of these multipurpose machines involved the use of dedicated weight stacks for each station, with the stations being located about a single structure. Thus, while the overall footprint of the machine was less than that of the sum of the footprints of single purpose weight lifting machines, the total amount of materials used, especially the weights used, remained nearly the same.

Later improvements to the concept of a multipurpose weight machine utilized fewer weight stacks or a centralized weight stack that was connectable to a plurality of exercise stations. While this method of constructing the machine decreased the total amount of weights necessary, it required a user to "set up" the machine for each desired exercise, e.g., connecting the desired station's cable to the weight stack after disconnecting the cable from another station.

An inherent shortcoming regarding cable lift systems, however, is the inevitable stretching of the cables, especially when lifting great weight. Cables of the type commonly used in weight lifting machines yield slightly during initial loading that occurs when lifting a weight stack or generally overcoming a resistive force. This slight yielding or stretching results in a "spongy" feel) perceived by the user. It is therefore desirable to construct a multipurpose weight machine that reduces or eliminates the stretch potential of cables subject to large lifting forces.

Another shortcoming regarding multipurpose weight lifting machines concerns the bench press station. When engaging in the bench press lifting exercise using free weights, the path of extension and flexion is determined by the user. This permits the user to lift weights in the most natural and efficacious manner. However, when operating a bench press station in a weight lifting machine, traditional methods have provided for a press arm wherein either the distal portion was pivotally connected to the machine's frame and the proximal portion comprised the press bar wherein the arm would swing in an arcuate path, or a linear lift press arm wherein the distal portion was translatable along a vertical track thereby confining the arm to a linear path. In both methods, the weights were connected to the arm at a point generally intermediate the distal and proximal portions.

Two consequences resulted from the geometry used in the pivoting arm method, depending upon the means employed to lift the weight stack. First, because the weight is attached at a midpoint a mechanical advantage results in a decreased effective weight at the lift point. Consequently, a load must be presented to the lifting bar that is greater than would be necessary if there was no mechanical advantage. Second, either a flexible link was needed to attach the weight stack to the arm of the press (a link pivoting at both the weight stack to link connection and the link to arm connection) or a follower that traveled along the arm was needed to translate the arcuate motion of the arm to linear motion of the weight stack.

When using the follower connection, the arcuate motion of the arm was effectively translated into linear motion of the weight stack, however, the user encountered progressively greater resistance to lift effort as the follower moved the arm to weight stack connection location progressively towards the press bar during extension of the arms, thus losing mechanical advantage. When using a pivoting link, the effective weight lifted by a user would not appreciable change, however, the weight stack would tend to bind against the guide rods of the stack because the vector of the lifting force would no longer be parallel to the guide rods. As with the follower solution, the nature of the press bar lifting path was not changed. Finally, if a rigid link was used between the press bar and the weight stack, then the weight stack must be pivotal at the base to accommodate the arcuate path of the press bar and arm.

SUMMARY OF THE INVENTION

The present invention concerns an exercise apparatus characterized as having a plurality of exercise stations located about a base platform and a single load, the load preferably being a weight stack movable in a conventional manner through direct and indirect forces applied thereto by the various exercise stations. Each station generally has several apparatus connectable to one or more cables that are operatively linked to all other stations and effect movement of the weight stack preferably by a single cable when any cable undergoes tensioned movement. Thus, tensioned movement of a cable at any exercise station will indirectly impart movement of the weight stack in a predetermined manner. In addition, at least one station directly imparts movement of the weight stack by means of non-cable linkage.

The non-cabled linkage or direct lift of the weight stack is carried out by providing for a translation assembly to be located in operative engagement with the weight stack to which the cable, operatively linked to other stations, is anchored. The translation assembly is engagable with a rigid member associated with the direct force applying station. In a preferred embodiment, the translation assembly comprises a roller assembly and the rigid member comprises a yoke. The yoke is preferably located under the rollers so that as the yoke is moved upwardly, it causes a corresponding upward movement of the roller assembly, and thus elevation of the weight stack. Because the yoke is preferably under the roller assembly, upward movement of the weights when the yoke is stationary does not impart a corresponding upward movement of the yoke assembly—the weight stack is unaffected by the presence of the direct lift station and conversely, movement of the weight stack by tensioned movement of a cable by an exercise station does not affect the direct lift station.

A feature of the invention provides for the use of a parallelogram lifting assembly to modify the nature of arcuate travel of a press handle assembly associated therewith. In co-pending U.S. patent application Ser. No. 07/838,472, filed on Feb. 19, 1992 and issued on Aug. 9, 1994, as U.S. Pat. No. 5,336,148, such an assembly is described and is incorporated herein by reference. In a preferred embodiment of the present invention, the parallelogram lifting assembly includes the previously mentioned yoke that directly engages the weight stack, although indirect cable linkage is equally suitable. By locating the press handle assembly at the movable vertically oriented component of the parallelogram lifting assembly, the press handle assembly's path of movement more closely approximates the optimal lifting path for performing bench press type exercises.

Another feature of the invention concerns an angle adjustment assembly for modifying the user engagable member of a movable member thereof that is linked to the load. Thus, the user engagable portion of the movable member can be adjusted to provide optimal initial lifting engagement. The assembly generally comprises a positively locking angle adjustment mechanism disposed intermediate to the movable member and the user engagable member.

The mechanism comprises a first housing plate and a second housing plate attached to the distal end of the movable member, defining two opposing sides of a movable member housing and further defining an axis of rotation for the user operable member, the movable member housing having disposed therein at least one notch plate characterized as having a plurality of notches formed in a generally arcuate pattern, the axis of the pattern being congruent with the axis of the user operable member rotation; and an arm assembly attached to the user operable member and pivotally receivable by the movable member housing at the axis of rotation, the arm assembly comprising a third plate and a fourth plate held in spaced apart relationship by at least the user operable member, and a lever pivotally mounted substantially there between wherein the lever acts upon a selector pin associated with at least the third plate and is selectively locatable in the plurality of notches in the notch plate so as to positively retain the angular relationship between the movable member housing and the user operable arm assembly when the pin is located in a notch.

These and other features of the invention will become apparent from inspection of the accompanying drawings and review of the following description of the invention.

BRIEF DESCRIPTION OF THE DRAWINGS

FIG. 6 is an isolated perspective view of the parallelogram direct lifting assembly emphasizing the interrelationship of the yoke assembly and the roller assembly associated with the weight stack;

FIG. 7 is an exploded perspective view of the roller assembly and its attachment with the top plate of the weight stack.

DESCRIPTION OF THE INVENTION

Figure 1:
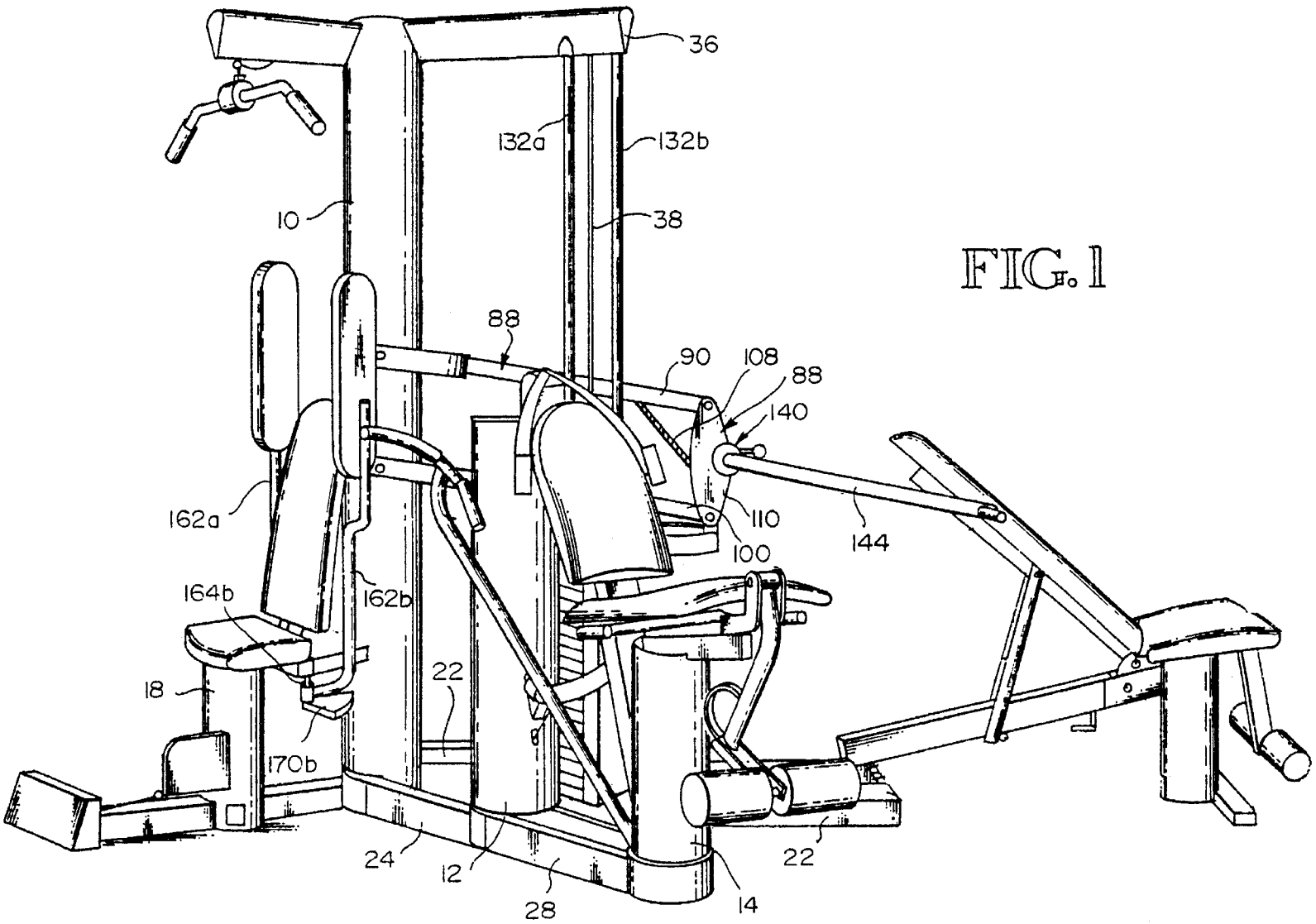
FIG. 1 is a perspective view of a weight lifting machine embodying the invention.
Figure 2:
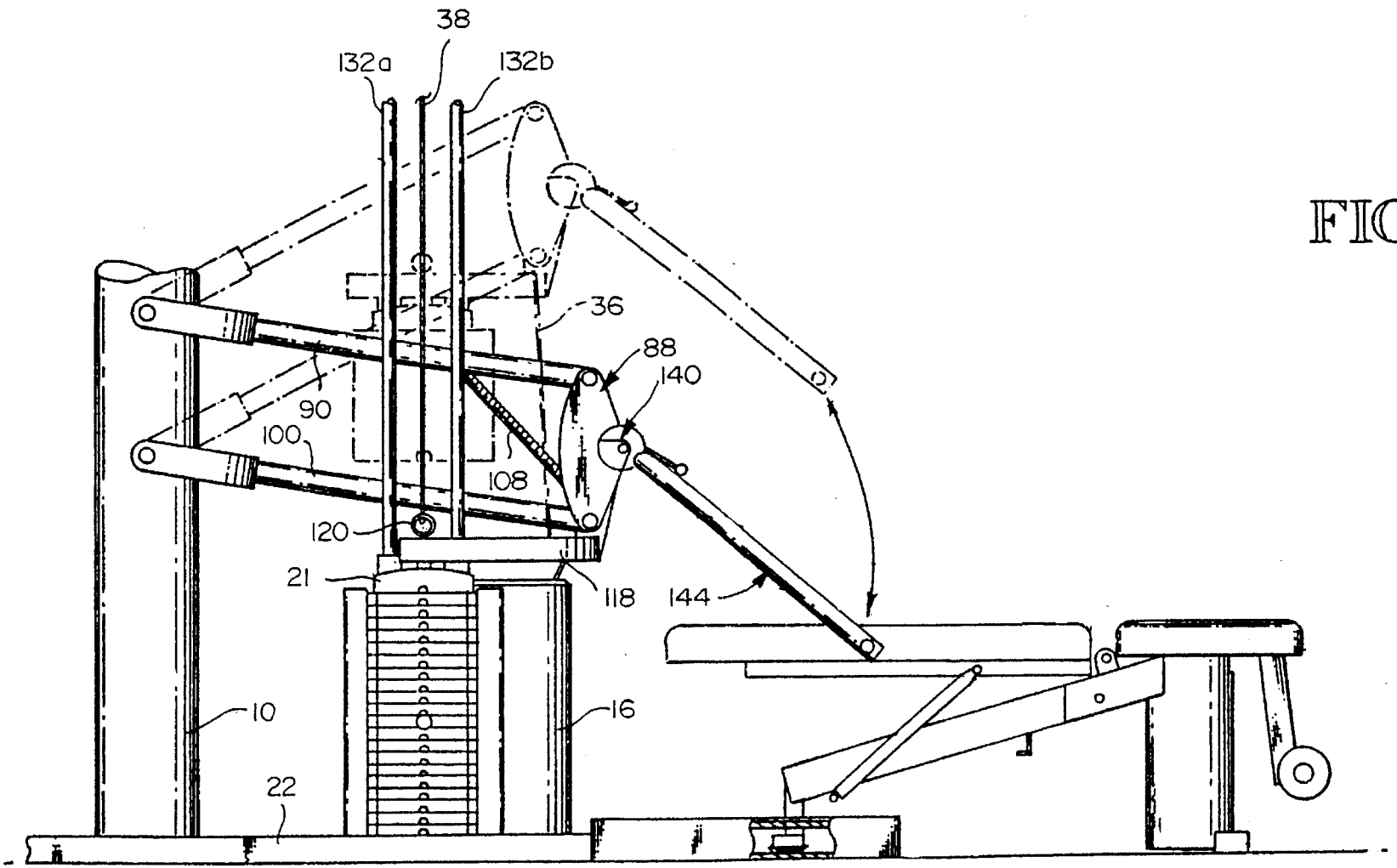
FIG. 2 is an elevation view of a press station showing the parallelogram direct lifting assembly in a resting state and, in phantom, in an extended state.
Figure 3:
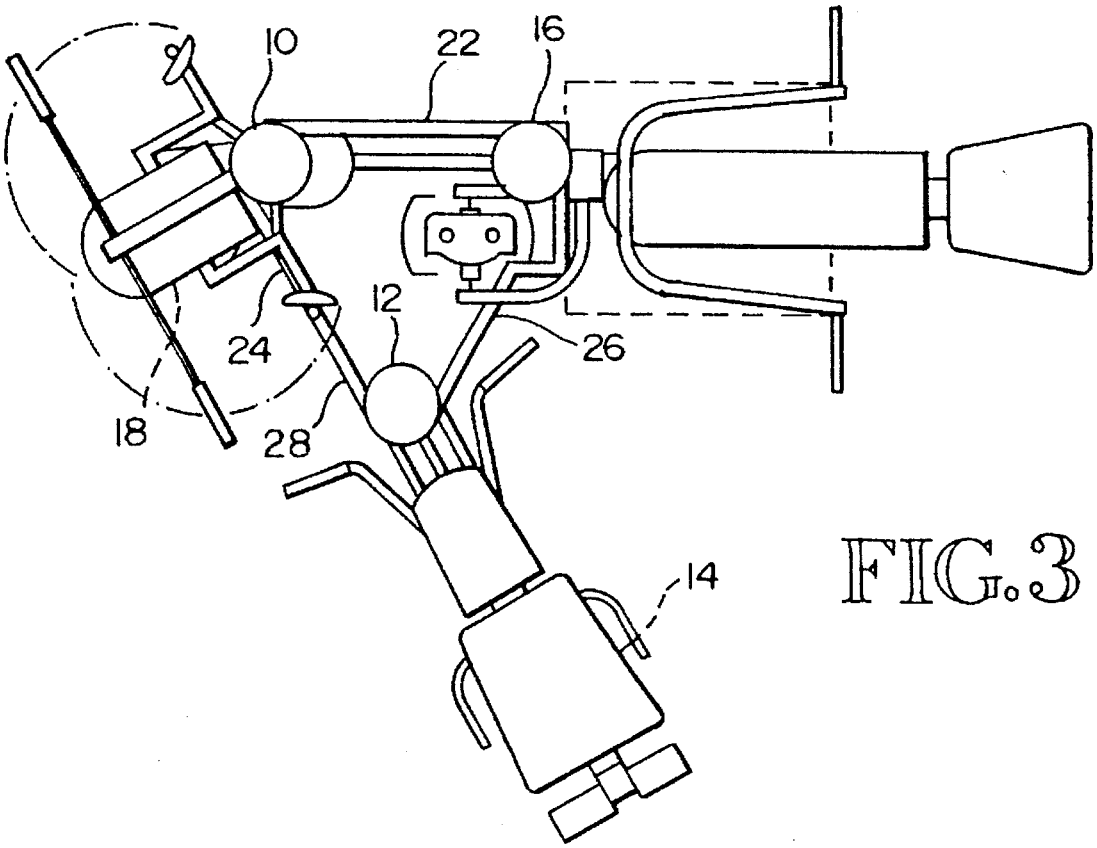
FIG. 3 is a plan view of the weight lifting machine showing the overall layout of the machine and stations.

Referring now to the several figures wherein like numerals indicate like parts and more particularly to FIGS. 1, 2 and 3, a perspective, elevation, and plan view of a single weight stack, multiple station exercise system are shown. The system comprises main column 10, ab/row column 12, leg/ab column 14, press column 16, and seat column 18 advantageously grouped and held in spaced relationship by main frame member 22, frame member 24, frame member 26, and frame member 28. The system also has weight stack 20 located in the triangular area created by the frame members which preferably comprises a plurality of weight plates maintained in vertical registry by weight guides **132*a* and 132*b*, and vertically depending weight selector shaft 130 through which a pin may be located to mechanically connect a desired number of weight plates to the shaft so as to vary the weight lifted by a user at any one station when lat/stack cable 38** undergoes tensioned movement. All structure is preferably steel; all pulleys are preferably fiberglass reinforced nylon with ball bearing hubs.

Figure 4:
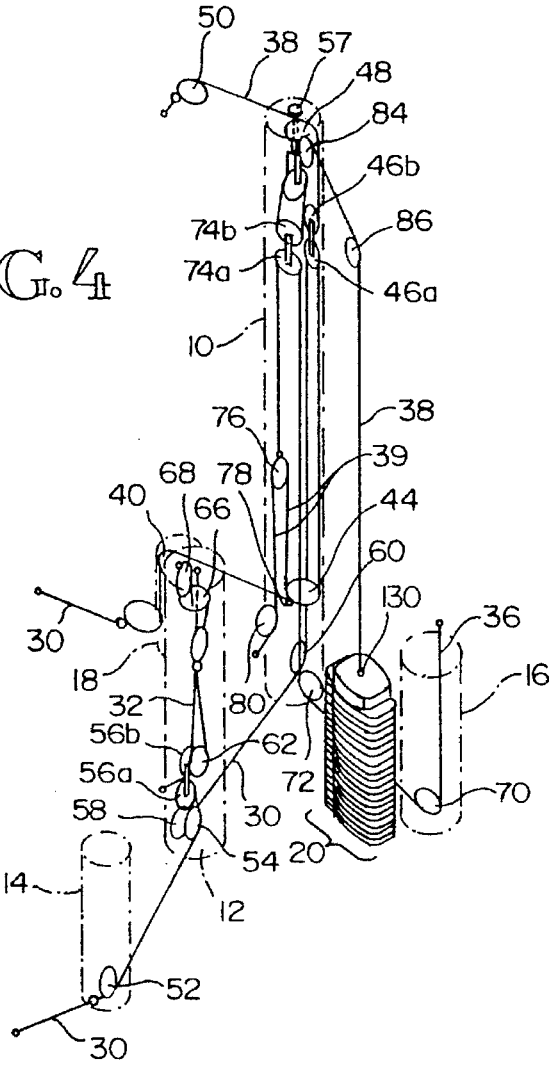
FIG. 4 is a diagrammatic perspective view of the invention showing the cable routing paths for the various exercise stations.
Figure 5:
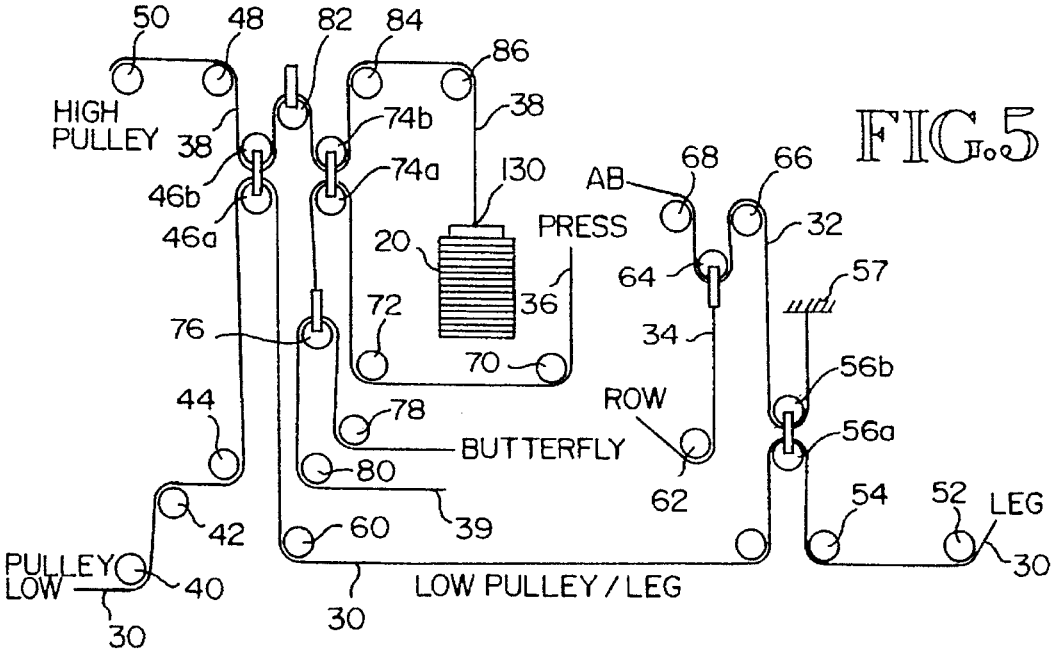
FIG. 5 is a schematic variation of FIG. 4.

Indirect Lifting System:

The vertical columns of the weight machine contain a plurality of pulleys which direct the travel of a plurality of cables that advantageously link the various exercise stations to weight stack 20 via lat/stack cable 38. Understanding of the cable paths of the invention will assist the reader in better understanding the invention. Consequently, attention is directed to FIGS. 4 and 5 wherein a simplified cable layout and cable diagram are shown. Each exercise station, each of which is capable of accommodating a plurality of weight lifting exercises, is located at one of the referenced columns. It should initially be noted that all cable free ends have stoppers in the form of radially compressible sleeves or balls located adjacent to a non-movable portion of the system so as to prevent any cable from undesirably retracting into the system. In a resting state, all stoppers should be adjacent to the non-movable portion. Often, it is convenient to place a stopper adjacent to the pulley nearest to the illustrated free ends. For example, stopper 41 is in close proximity to pulley 40, and stopper 51 is in close proximity to pulley 50. The consequence of this geometry permits only weight stack 20 to move in response to tensioned movement of any cable as will be detailed below.

Beginning first at column 18, low/leg cable 30 is first redirected into seat column 18 via pulley 40 and redirected therein towards main column 10 by pulley 42. Pulley 44 directs cable 30 around pulley **46*a* so that vertical movement of pulley assembly 46 will cause deflection of lat/stack cable 38. Because cable 38 opposes tensioned retraction via stopper 51, deflection of cable 38 causes weight stack 20 to move in response thereto. Cable 30 is then directed to pulley 52 in column 14 via pulley 60 in column 10, and pulleys 58, 56*a*, and 54 located in column 12. Thus, by causing tensioned movement of cable 30 such as by pulling the terminal end of cable 30 at pulley 40 or pulling the terminal end of cable 30 at pulley 52, floating pulley assembly 46 deflects cable 38 which in turn moves weight stack 20. Similarly, deflection of cable 30 will initiate tensioned movement thereof which in turn will cause weight stack 20** to move.

Deflection of low/leg cable 30 is accomplished either by tensioned movement of ab cable 32 or row cable 34 located in column 12. Tensioned movement of cable 32 causes movement of cable 32 over pulleys 68, 64, 66, and 56*b*. Because row cable 34 is prevented from retracting and cable 32 is anchored to column 12 at point 57, floating pulley assembly 56 will cause deflection of low/leg cable 30. Similarly, tensioned movement of row cable 34 will cause deflection of ab cable 32 which in turn imparts tensioned movement of low/leg cable 30 as previously described.

In a like wise manner, direct tensioned movement of press cable 36 causes a downward movement of floating pulley assembly 74 which in turn deflects lat/stack cable 38, resulting in elevation of weight stack 20. Alternatively, indirect tensioned movement of cable 36 such as by tensioned movement of butterfly cable 39, also will result in deflection of cable 38.

Thus, it can be seen that there are eight separate cable terminations engagable with appropriate accessories that can impart tensioned movement to cable 38 when tensioned by a user. The present configuration advantageously permits a 1:1 effort ratio so as to maintain the accuracy of the weight indicia on weight stack 20.

The Direct Lift Press and Parallelogram Lifting Assembly:

The present invention also comprises a direct lift press utilizing a parallelogram lifting assembly. By this combination, cable stretch inherent when lifting weights during operation is eliminated, and a more natural lifting path is established. More over, the present invention accomplishes these benefits without the necessity of using a tiltable weight stack.

Referring then to FIGS. 2, 6, and 6*a*, parallelogram lifting assembly 88 comprises upper press pivot arm 90 having yoke portion 92, arm 94, and sleeve 96; lower press pivot arm 100 having yoke portion 102, arm 104, and sleeve 106. Both yoke portion 92 and yoke portion 102 are pivotally connected to main column 10 via a shaft and ball bearing combination although traditional means such as low friction bushings may also be used. Sleeve 96 and sleeve 106 are pivotally attached to press housing 110 by similar means and are equally amenable to other traditional pivoting means.

Press housing 110 is characterized as having pivot plates 112*a* and 112*b* and 114*a* and notch plates 114*b* joined to form unitary pieces, the unitary pieces being fixedly held in spaced apart relation by shields 116*a*, 116*b*, and 116*c*, and yoke assembly 118. These components, in conjunction with press handle assembly 140, which will be discussed in greater detail below, comprise parallelogram lifting assembly 88.

From inspection of the several figures, it will be noted that lifting assembly 88 is directly and indirectly connected to weight stack 20 via selector shaft 130. In a traditional fashion, operation of lifting assembly 88 causes tensioned movement of press cable 36 which, as previously described, causes deflection of lat/stack cable 38 and thereby causes weight stack 20 to elevate when selector shaft 130 is engaged therewith. This is considered indirect elevation of weight stack 20.

In additional to the plurality of weight plates which comprise weight stack 20, is roller assembly 120 which comprises rectangular member 122, horizontal member 123 disposed therein, roller spindles 124*a* and 124*b*, mounted to rectangular member 22 in opposing fashion, on which are located rollers 126*a* and 126*b*. Both lat/stack cable 38 and roller assembly 120 are fixedly attached to selector shaft 130. Thus when lat/stack cable 38 undergoes tensioned movement, the lifting force inherent therein is transmitted to selector shaft 130 via attaching strap 138. Similarly when roller assembly 120 undergoes elevated movement, the lifting forces inherent therein are transmitted to selector shaft 130 via the interaction of horizontal member 123 acting on strap 138. To ensure that rollers 126*a* and 126*b* are equally loaded during operation of the press, roller assembly 120 is pivotal about pin 123 so that any unequal loading forces presented by yoke 118 are compensated for when presented to weight stack 20.

The purpose of incorporating roller assembly 120 will now be described. Rigidly mounted to lifting assembly 88 is yoke assembly 118, having a pair of spaced apart in distance equal to distance between rollers 126A and 126B. The yoke assembly 118 is disposed underneath and adjacent to rollers 126A and 126B. Therefore it can be seen that attaching strap 138 transmits tensioned movement of cable 38 or elevated movement of roller assembly 120 via elevation of yoke assembly 118 into elevation of selector shaft 130 or weight stack 20 when shaft 130 is engaged therewith. Consequently, because of this geometry, the direct and indirect forces applied to selector shaft 130 or stack 20 complement one another and advantageously permit direct elevation of the same while eliminating cable slack that would otherwise be apparent if lifting assembly 88 was not connected to press cable 36.

By incorporating parallelogram lifting assembly 88 for the press aspects of the system, the traditional path of press handle motion is enhanced. In conventional press arm assemblies the arm pivots about its distal end, and the proximal end, where the user operates the station, swings in an arcuate path having a constant radius about the distal pivot point. By contrast, when press handle assembly 140 is used in conjunction with parallelogram lifting assembly 88, press housing 110 remains in a substantially vertical alignment so that press handle assembly 140 remains at a constant angle relative to the user thus permitting a substantially 1:1 lifting effort over the entire range of motion, i.e. the press handle assembly does not participate in leveraged action; the additional length of the handle assembly is not included in the mechanical advantage regarding the weights.

Should a user of parallelogram lifting assembly 88 desire to reduce the apparent weight of weight stack 20, tension spring 108 may be used. By attaching one end of spring 108 to eye 98 of upper press pivot arm 90 and one end to eye 117 of press housing 110 as is best shown in FIG. 2, the natural restoring force of tension spring 108 causes the lower portion of press housing 110 near the pivot point of lower press pivot arm 100 to be drawn towards arm portion 94 of upper press pivot arm 90. Since the direction of this motion occurs when lifting assembly 88 is raised from its resting position, the apparent weight experienced by a user elevating lifting arm assembly 88 is accordingly reduced.

Figure 8:
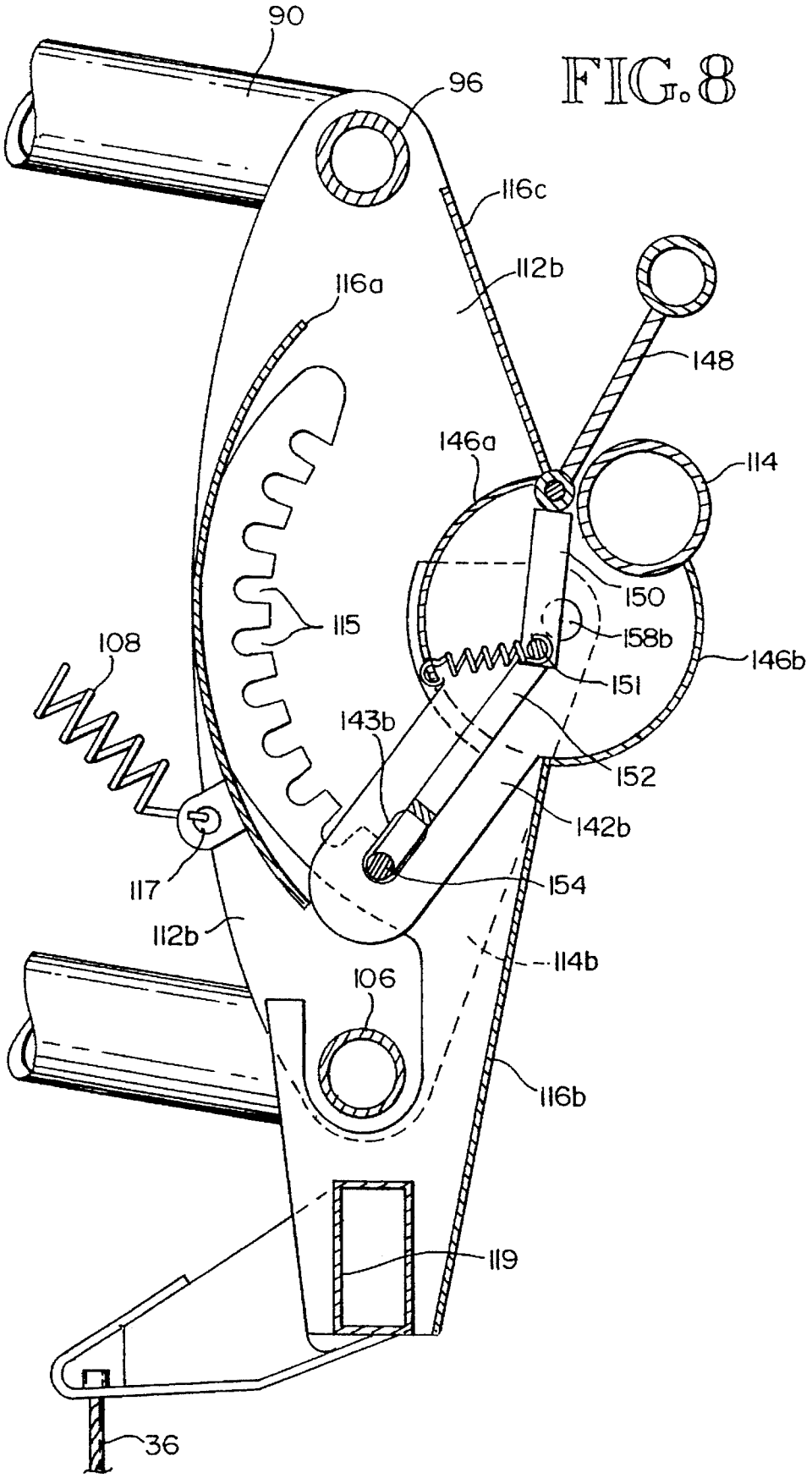
FIG. 8 is a cross section of the press housing and the press handle assembly detailing the mechanics associated with the adjustment of the press yoke.

It was earlier mentioned that the nature of the path of motion of press handle assembly 40 was determined in large part by the angle created between it and press housing 110. To provide for a great variety of possible angles, a positively locking angle adjusting mechanism is provided. Referring specifically to FIG. 8, a cross section of the adjusting mechanism is shown. The outer structure of press housing 110 is comprised of a pair of two distinct elements, namely pivot plates 112*a* and 112*b*, and notch plates 114*a* and 114*b* preferably welded together as shown. Pivot plate 112*a* and notch plate 114*a* are maintained in spaced apart relation from corresponding pivot plate 112*b* and notch plate 114*b* by spacer 119, sleeves 96 and 106, and shields 116*a–c* (see generally FIG. 6A). Insertible into press housing 110 is press handle assembly 140 which includes plates 142*a* (hidden)

and 142*b* which are held in spaced apart relationship by press yoke 144 and tube sections 146*a* and 146*b*. Press handle assembly 140 pivots about point 158*a* (see FIG. 2) and 158*b*. Plates 142*a* and 142*b* are characterized as generally circular in nature with an arm extending therefrom, each arm having a slot 143 formed in the distal portion thereof.

Disposed within and extending in two directions beyond the chamber defined generally by plates 142*a* and 142*b*, and tube sections 146*a* and 146*b* is the angle adjusting assembly comprising externally disposed lever 148 having a pivot rod 149 located between plates 142*a* and 142*b* to permit pivotal movement thereof, lever extensions 150*a* and 150*b* fixedly attached to lever 148, pivotally connecting rods 152*a* and 152*b* by means of pivot rod 151*a*. Connecting rods 152*a* and 152*b*, when acted upon by movement of lever 148 and extensions 150*a* and 150*b*, extend and retract pin 154 into and out of notches 115. Pin 154 is only permitted to move radially since each end is located in a slot 143 formed in each plate 143. Spring 156 is used to provide a restoring bias so that pin 154 remains distally located in slots 143*a* and 143*b*. From this geometry, rotational movement of press handle assembly 140 about pivots 158*a* and 158*b* is restricted by the interaction of pin 154 in notches 115 until lever 148 is acted upon so as to overcome the restoring bias of spring 156 and therefore cause pin 154 to move radially inwardly and away from notches 115.

Industrial Applicability:

The present invention will find utility in the commercial and private fitness industry. The high level of integration makes it possible to have many machines located in one area, or a single machine located in a small space. The claimed features of the invention permit the machine to be more effective in providing conditioning to a user and increases the reliability and usefulness thereof.

What is claimed is:

1. A multiple station, single load exercise machine comprising:

a frame to provide suitable mounting locations for multiple exercise stations;

a first exercise station having user operated functional portions;

a load to provide variable resistance to forces applied thereto;

a first cable operatively linking the user operated functional portions of the first exercise station to the load whereby the operation of the first exercise station causes tensioned movement of the first cable when presented with a force sufficient to overcome the resistance provided by the load;

a second exercise station having user operated functional portions and having a rigid member operatively linking the user operated functional portions of the second exercise station to the load by non-cable means whereby operation of the second exercise station provides an opposing force to the resistance provided by the load; and means for preventing incidental movement of the user operated functional portions of the first exercise station during operation of the second exercise station wherein tensioned movement of the first cable of the first exercise station does not cause movement of the user operated functional portions and rigid member of the second exercise station.

2. The exercise machine of claim 1 wherein the load comprises a weight stack having a plurality of weight plates held in substantial vertical registry by at least one guide member and having a substantially vertically depending weight selector to selectively engage one or more weight plates, the weight selector being operatively linked to the first cable.

3. The exercise machine of claim 2 further comprising a roller assembly fixedly attached to the weight selector and adapted to engage a portion of the rigid member whereby the roller assembly translates a substantially vertical vector component of the motion of the rigid member during operation of the user operated functional portion of the second station into substantially vertical movement of the weight stack.

4. The exercise machine of claim 1 wherein the user operated functional portion of the second exercise station comprises an arm pivotally mounted to the frame at a proximal end and wherein the rigid member is connected to the arm.

5. The exercise machine of claim 1 wherein the second exercise station comprises an arm pivotally mounted to the frame at a proximal end and wherein the rigid member is connected to the arm, and wherein the load comprises a weight stack having a plurality of weight plates held in substantial vertical registry by at least one guide member and having a substantially vertically depending weight selector to permit user selection of one or more weight plates, the weight selector being operatively linked to the first cable.

6. The exercise machine of claim 5 further comprising a roller assembly fixedly attached to the weight selector and adapted to engage a portion of the rigid member whereby the roller assembly translates a substantially vertical vector component of the motion of the rigid member during operation of the user operated functional portion of the second station into substantially vertical movement of the weight stack.

7. The exercise machine of claim 1 wherein the means for preventing incidental movement comprises a second cable operatively linked to the first cable at one end and attached to the user operated functional portion of the second station whereby movement of the user operated functional portion of the second station imparts tensioned movement of the first cable to thereby assist in providing an opposing force to the load.

8. The exercise machine of claim 1 wherein the second exercise station comprises:

a first press pivot arm pivotally mounted at a first end to a substantially vertical member of the frame;

a second press pivot arm pivotally mounted at a first end to the substantially vertical member and positioned so as to be substantially vertically displaced from the first press pivot arm;

a connecting member pivotally connecting the second ends of the first and second press pivot arms whereby the first and second press arms, the vertical member, and the connecting member collectively define the boundaries of a parallelogram; and a press yoke attached to the connecting member to provide a suitable means for a user to operate the press station wherein the rigid member links the parallelogram to the load.

9. The exercise machine of claim 8 further comprising a second cable operatively linked to the first cable at one end and attached to the parallelogram whereby movement of the press yoke imparts tensioned movement of the second cable.

10. The exercise machine of claim 8 wherein the load comprises a weight stack having a plurality of weight plates held in substantial vertical registry by at least one guide member and having a substantially vertically depending weight selector and further comprising a roller assembly fixedly attached to the weight selector and adapted to engage a portion of the rigid member whereby the roller assembly translates a substantially vertical vector component of the motion of the rigid member during operation of the user operated functional portion of the second station into substantially vertical movement of the weight stack.

11. The exercise machine of claim 8 wherein the load comprises a weight stack having a plurality of weight plates held in substantial vertical registry by at least one guide member and having a substantially vertically depending weight selector, and further comprising a roller assembly fixedly attached to the weight selector and adapted to engage a portion of the rigid member whereby the roller assembly translates a substantially vertical vector component of the motion of the rigid member during operation of the user operated functional portion of the second station into substantially vertical movement of the weight stack, and further comprising a second cable operatively linked to the first cable at one end and attached to the parallelogram whereby movement of the press yoke imparts tensioned movement of the second cable.

12. A multiple station, single load exercise machine comprising:

a frame to provide suitable mounting locations for multiple exercise stations;

a first exercise station having user operated functional portions;

a load to provide variable resistance to forces applied thereto;

a first cable operatively linking the user operated functional portions of the first exercise station to the load whereby the operation of the first exercise station causes tensioned movement of the first cable when presented with a force sufficient to overcome the resistance provided by the load;

a second exercise station having user operated functional portions and having a rigid member linked to the load whereby operation of the second exercise station provides an opposing force to the resistance provided by the load; and a second cable operatively linked to the first cable at one end and attached to the user operated functional portions of the second station whereby movement of the user operated functional portion of the second station imparts tensioned movement of the second cable wherein tensioned movement of the first cable of the first exercise station does not cause movement of the user operated functional portions and rigid member of the second exercise station.

13. The exercise machine of claim 12 wherein the load comprises a weight stack having a plurality of weight plates held in substantial vertical registry by at least one guide member and having a substantially vertically depending weight selector to selectively engage one or more weight plates, the weight selector being operatively linked to the first cable.

14. The exercise machine of claim 13 further comprising a roller assembly fixedly attached to the weight selector and adapted to engage a portion of the rigid member whereby the roller assembly translates a substantially vertical vector component of the motion of the rigid member during operation of the user operated functional portion of the second station into substantially vertical movement of the weight stack.

15. The exercise machine of claim 12 wherein the user operated functional portion of the second exercise station comprises an arm pivotally mounted to the frame at a proximal end and wherein the rigid member is connected to the arm.

16. The exercise machine of claim 12 wherein the second exercise station comprises an arm pivotally mounted to the frame at a proximal end and wherein the rigid member is connected to the arm, and wherein the load comprises a weight stack having a plurality of weight plates held in substantial vertical registry by at least one guide member and having a substantially vertically depending weight selector to permit user selection of one or more weight plates, the weight selector being operatively linked to the first cable.

17. The exercise machine of claim 16 further comprising a roller assembly fixedly attached to the weight selector and adapted to engage a portion of the rigid member whereby the roller assembly translates a substantially vertical vector component of the motion of the rigid member during operation of the user operated functional portion of the second station into substantially vertical movement of the weight stack.

* * * * *